United States Patent [19]

Salam

[11] 3,995,386

[45] Dec. 7, 1976

[54] INFORMATION DISPLAY DEVICE

[76] Inventor: Hassan Paddy Abdel Salam, 80 Vicarage Court, London, W8 4HG, England

[22] Filed: July 3, 1975

[21] Appl. No.: 593,179

Related U.S. Application Data

[63] Continuation-in-part of Ser. No. 406,666, Oct. 15, 1973.

[30] Foreign Application Priority Data

Oct. 18, 1972 United Kingdom ..... 48029/72
Oct. 30, 1972 United Kingdom ..... 49877/72

[52] U.S. Cl. ..... 40/28 C
[51] Int. Cl.[2] ..... G09T 11/00
[58] Field of Search ..... 40/28 R, 28 C, 52 R; 340/373

[56] References Cited

UNITED STATES PATENTS

| | | | |
|---|---|---|---|
| 3,210,757 | 10/1965 | Jacob | 40/28 C |
| 3,426,453 | 2/1969 | Dingwall et al. | 40/28 C |
| 3,562,938 | 2/1971 | Salam | 40/28 C |
| 3,724,110 | 4/1973 | Meyerson | 40/28 C |
| 3,775,881 | 12/1973 | Salam | 40/28 C |

*Primary Examiner*—Louis G. Mancene
*Assistant Examiner*—John H. Wolff
*Attorney, Agent, or Firm*—Lawrence E. Laubscher

[57] ABSTRACT

An information display device includes a two-dimensional array of cells, each cell including an opaque wall pierced by an aperture and containing an opaque ferromagnetic spherical shutter member movable by electromagnetic means to roll upon a vertical wall of the cell between limiting positions in which it respectively exposes and occults the aperture. The shutter members may be restrained in their limiting positions by friction or magnets embedded in the cell walls.

2 Claims, 6 Drawing Figures

INFORMATION DISPLAY DEVICE

CROSS REFERENCES TO RELATED APPLICATIONS

This is a continuation-in-part of application Ser. No. 406,666, filed Oct. 15, 1973.

Information display devices having some features in common with the present invention are disclosed in co-pending U.S. Patent Application by Hassan P. A. Salam Ser. No. 243,950 now U.S. Pat. No. 3,775,881 entitled INFORMATION DISPLAY DEVICE.

BACKGROUND OF THE INVENTION

1. Field of the Invention

This invention relates to improvements in information display devices of the kind in which a plurality of shutter members are selectively movable to close or to leave unobstructed an individual aperture in a two-dimensional array of apertures, so as to form the characters or other symbols to be displayed.

2. Description of the Prior Art

In known devices of this kind, such as are described in my U.S. Pat. No. 3,562,938 the shutter members are discs movable in the plane of the array by rotation about an axis perpendicular to the plane of the array, rolling upon the floors of the respective cells. This movement is produced by magnetic fields acting upon the shutter member. In some embodiments of this known arrangement the disadvantage arises that there is very considerable friction between the shutter member and that wall of the cell against which it must slide, because the shutter member is urged against the cell wall by the magnetic field serving to produce its movement.

SUMMARY OF THE INVENTION

It is an object of the present invention to provide information display apparatus having advantages over the known devices in that lower operating forces are required.

It is a specific object of the invention to provide information display apparatus in which frictional forces on movable shutter members are minimized.

It is a further object of the invention to provide information display apparatus in which selective obstruction of light by shutter members is advantageously improved.

An information display device according to an embodiment of the present invention comprises a two-dimensional array of individual cells having first and second generally vertically disposed walls. Each cell includes in a first face of the array an opaque wall means having therein a light-transmissive area. Within each cell is an opaque, ferromagnetic shutter member arranged for rolling movement upon the inner surface of a generally vertical wall between first and second limiting positions. In one of its limiting positions the shutter member abuttingly engages the margins of the light-transmissive area to obstruct the passage therethrough of light incident upon the second face of the array, while in its other limiting position the shutter member permits the passage of light through that area.

Preferred features and advantages of embodiments of the invention will become apparent from the following description, taken in conjunction with the accompanying drawing, comprising FIGS. 1 to 5, of which:

Figure 1:
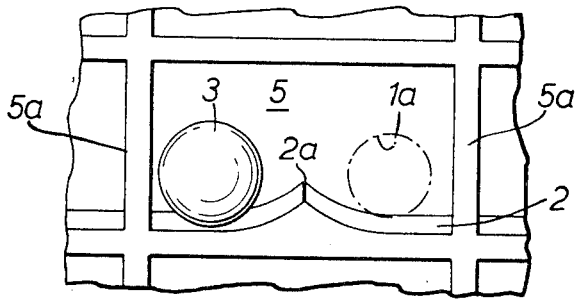
FIG. 1 is a sectional front elevation of one cell of an information display device.
Figure 2:
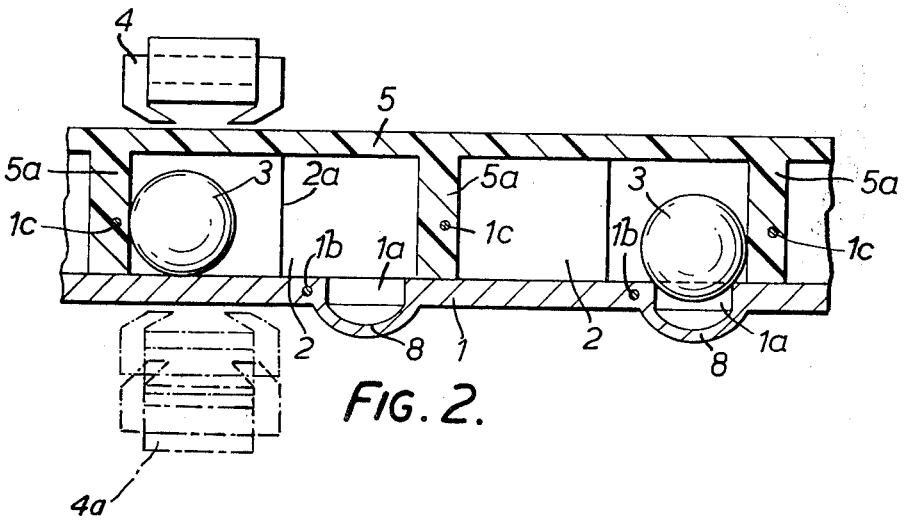
FIG. 2 is a sectional plan view of two adjacent cells of an information display device.
Figure 3:
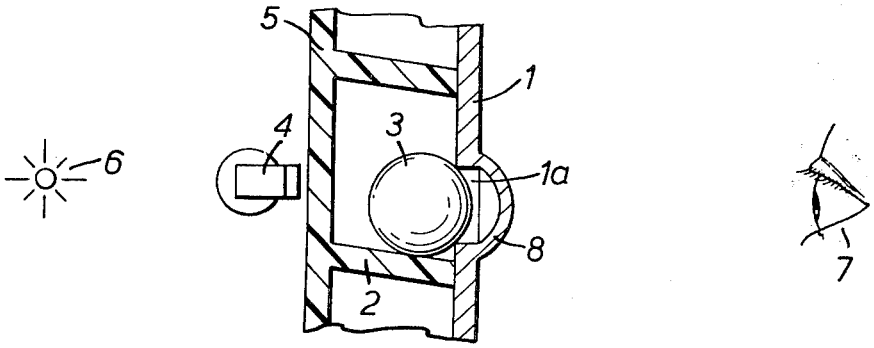
FIG. 3 is a sectional end elevation of a cell of the information display device.

In the embodiment illustrated by FIGS. 1 – 3, a device is assumed to consist of an array comprising a large plurality of cells. Each cell has an opaque wall 1 in the plane of the array, which has therein a transparent or translucent area 1*a* which will hereinafter be referred to as an aperture. In FIG. 1, wall 1 is not seen, but the position of the aperture is indicated at 1*a*. As most clearly seen in FIG. 3, the floor 2 of each cell slopes downwardly towards the wall containing aperture 1*a*, so that when the ball 3 which is contained in the cell is in that portion of the cell containing the aperture it will be gravitationally biased into engagement with the margin of the aperture. As the ball will be of ferromagnetic material, for purposes of positional control as described below, a similar effect may be achieved, in the absence of a sloped floor, by positioning a suitable magnet (1*b*) in the cell wall 1 adjacent the aperture 1*a*. In order to provide a bistable structure, in which the ball 3 must remain in position against one or other end wall 5*a* of the cell, the floor of the cell may rise to a ridge 2*a* midway between the cell ends. Alternatively, small magnets 1*c* may be embedded in the end walls 5*a* of the cell, which then has a flat floor. When a ridged cell floor is used, this may be formed of curved sections, as shown, or may comprise two oppositely sloping planar portions.

Movement of a shutter member between its two stable positions is effected by means of a travelling magnet system, similar to that described in U.S. Pat. No. 3,562,938, including an electromagnet 4 (FIGS. 2 and 3) for each horizontal row of cells. The vertical column of electromagnets is arranged for movement along the length of the array, with each magnet traversing a respective horizontal row of cells. The magnets are arranged adjacent the transparent wall 5 of the array and are arranged to be energized by the application to their respective windings of a current such as to produce a magnetic field of sufficient strength to cause the shutters 3 to be attracted to lie against the transparent rear wall of the array and to roll against that wall as the magnet moves longitudinally of the array. The vertical assembly of magnets is arranged to traverse the array of cells in one direction with all the magnets energized. All the shutter members in the individual cells are thus put into similar positions, either with all apertures unobstructed, or with all apertures obscured. The magnet assembly is then traversed across the array in the other direction and the individual magnets are selectively energized to produce movement of selected shutter balls to the other stable position in such a manner as to yield the required display.

In an alternative arrangement, the shutter-containing array may be arranged to move past a stationary system of electromagnets which are arranged to be appropriately energized in synchronism with the movement of the array so as to produce desired shutter movements.

The display device is arranged for viewing by transmitted light, that is, to be rear-illuminated. The rear wall 5 of the cells, and preferably the end walls 5*a* also, is made transparent or translucent and the array is positioned between a light source 6 (FIG. 3) and the observer, represented by an eye 7. The individual apertures may be provided with light-diffusing members 8, or these may be constructed as very thin "bubble" portions of wall 1, if this is formed of a material which when of substantial thickness is opaque.

Figure 4A:
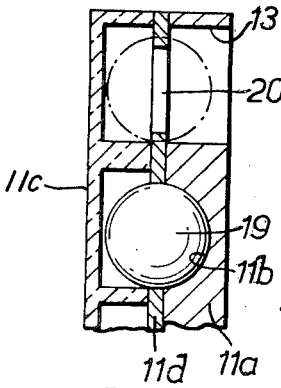
FIG. 4A is a sectional end view taken along line 4*a*—4*a* of FIG. 4.
Figure 4:
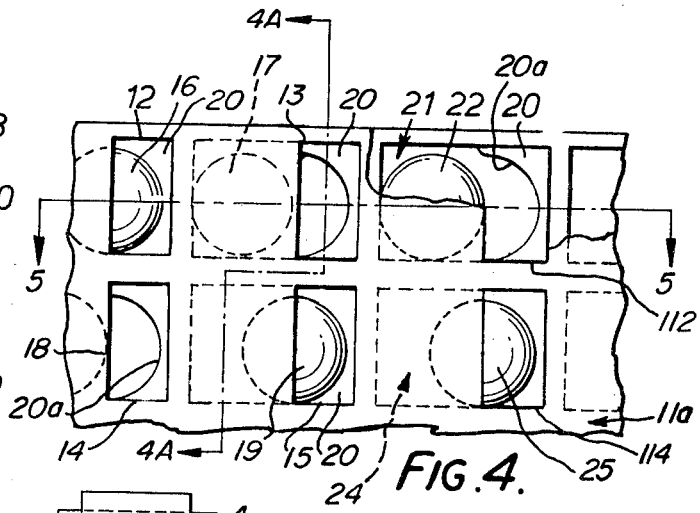
FIG. 4 is a partly sectional front elevation of a portion of another embodiment of display device.
Figure 5:
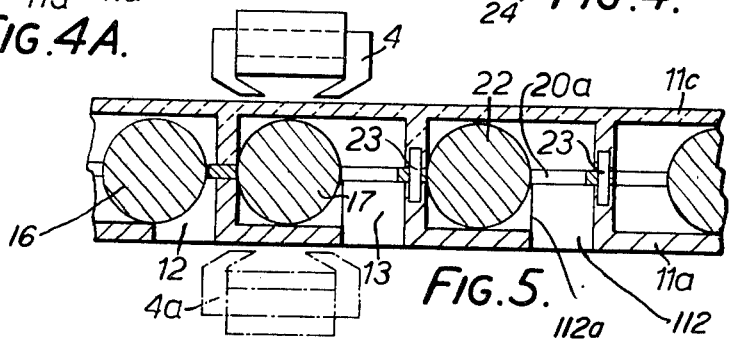
FIG. 5 is a sectional view taken along lines 5—5 of FIG. 4.

The left-hand portion of FIG. 4 shows the external appearance of a portion 11 of a display device including four apertures 12, 13, 14 and 15, of which apertures 12 and 15 are closed by respective spherical shutter members 16 and 19, while apertures 13 and 14 associated with shutter members 17 and 18, respectively, are unobstructed. It is seen that the apertures in the front or viewed side of the array are rectangular. Within each cell is a barrier, an opaque end wall portion 20 acting as a light barrier presenting to the shutter member a concave, mating semicircular edge 20*a* with its diameter vertical. As best seen in FIGS. 4A and 5, each cell is formed of an opaque member ll*a* presenting within the cell a semicircularly grooved front wall 11*b* substantially mating with the spherical shutter member rollably fitting in the cell. The cell also includes a transparent or translucent rear member 11*c* presenting within the cell a surface which may be formed of perpendicularly disposed planar surfaces, as shown, or may alternatively provide a semicircular groove similar to that of member 11*a*. Between members 11*a* and 11*c* is an opaque member 11*d* which provides the barriers 20. Member 11*a* is cut away to form the apertures 12, 13, 14, 15, 112 and 114, so that when a shutter member is disposed at the end of its cell remote from the aperture (as illustrated by shutter 17 in FIG. 5), light may pass unobstructedly past barrier 20, while when the shutter member abuts the semicircular edge 20*a* substantially all light from passing (as illustrated by shutter 16 in FIG. 5).

The right-hand portion of FIG. 4 shows parts of four cells of the array with the front wall partially removed. The cell 21 is seen to contain a spherical shutter member 22 which is positioned to leave the cell aperture 112 unobstructed. The cell 24 contains a spherical shutter member 25 which is positioned to close the cell aperture. The effective aperture is formed by the semicircular edge 20*a* of barrier member 20 and by the end wall 112*a* formed by the rectangular aperture 112 in the opaque, grooved front cell wall 11*a*. The margin of the aperture actually obstructed by the sphere is thus defined by two semicircles in perpendicular planes. It will be seen that the maximum periphery of the shutter member 25 abuts against the conforming semicircularly formed barrier member 20 extending inwardly of the cell from the right-hand end wall 26 while another maximum periphery abuts against the boundary of the aperture formed by the grooved front wall 11*b* of the cell. When a shutter member is thus positioned it will completely prevent the passage of light through the aperture.

Small magnets 23 may be provided in the end walls of the cells to provide stable positions for the shutter member, or alternatively the floor of the cell may rise to a ridge midway between its ends.

As before, the movements of the shutter members between their limiting positions will be controlled by electromagnetic means (such as electromagnet 4) arranged in a vertical column and arranged for relative movement between the electromagnetic means and the array in a horizontal direction.

In alternative embodiments of the invention the electromagnetic means may be arranged to traverse the array in proximity to the front, opaque wall rather than the rear wall of the array, as indicated in broken line at 4*a* in FIGS. 2 and 5.

What I claim is:

1. In a rear-illuminated display apparatus including means defining a two-dimensional planar array of cells, each of said cells including parallel spaced first (1) and second (5) generally vertical wall means, and bottom (2), top, and end (5*a*) wall means, respectively, said first vertical wall means being opaque and containing for each cell a circular aperture (1*a*) adjacent one end of said cell, said second vertical wall means being light-transmissive, a plurality of opaque ferromagnetic shutters (3), each of said cells containing one of said shutters, respectively, means (2, 1*c*) defining for each cell bistable first and second limiting positions at opposite ends of said cell between which said shutter is horizontally displaceable relative to said aperture in a direction parallel to the plane of the array, the aperture of each of said cells being so arranged that the passage of light through said aperture is prevented and permitted when said shutter is in said first and second limiting positions, respectively, and electromagnetic means (4, 4*a*) arranged for movement relative to said array of cells in a horizontal direction parallel to the plane of the array for displacing each of said shutters selectively between said first and second limiting positions, the improvement wherein a. each of said shutters is spherical and free to rotate about a vertical axis; and b. biasing means (2, 1*b*) associated with each of said cells, respectively, for biasing each of said shutters when in its first limiting position toward said first vertical wall to cause a portion of said shutter to extend into engagement with the margin of said aperture and thereby preclude the passage of the rear illumination through the apertures of those cells having shutters in said first limiting position, whereby each of said spherical shutters is adapted to be magnetically attracted against one of said vertical walls for rolling transport thereacross during displacement of said shutters between said first and second limiting positions.

2. In a rear-illuminated display apparatus including means defining a two-dimensional planar array of cells each including parallel spaced first (11*a*) and second (11*c*) generally vertical wall means, and bottom, top and end wall means, respectively, said first vertical wall means being opaque and containing an aperture adjacent one end of said cell, said second vertical wall means being light-transmissive, a plurality of opaque shutters, each of said cells containing one of said shutters, respectively, means (23) defining for each cell bistable first and second limiting positions at opposite ends of said cell between which said shutters are horizontally displaceable relative to said aperture in a direction parallel to the plane of the array, the aperture of each of said cells being so arranged that the passage of light through said aperture is prevented and permitted when said shutter is in said first and second limiting positions, respectively, and electromagnetic means arranged for movement relative to said array of cells in a horizontal direction parallel to the plane of the array for displacing each of said shutters selectively between said first and second limiting positions, the improvement a. wherein each of said shutters is spherical and free to rotate about a vertical axis for translation in a vertical plane containing said axis;

b. wherein said first vertical wall (11*a*) contains for each cell a semi-circular horizontal groove (11*b*) partially and matingly receiving the associated spherical shutter, said groove terminating at one end (112*a*) in communication with the associated aperture;

c. and further wherein the end wall means (20) of each cell adjacent the aperture thereof is opaque and contains a semicircular recess (20*a*) for also partially receiving the associated spherical shutter when said shutter is in the first limiting position, thereby preventing the passage of the rear illumination through the apertures of those cells having shutters in the first limiting position, respectively.

* * * * *